US007796144B2

(12) United States Patent
Huang

(10) Patent No.: US 7,796,144 B2
(45) Date of Patent: Sep. 14, 2010

(54) GAMMA CORRECTION DEVICE OF DISPLAY APPARATUS AND METHOD THEREOF

(75) Inventor: Jiunn-Yau Huang, Hsinhua (TW)

(73) Assignee: Himax Technologies Limited, Tainan County (TW)

( * ) Notice: Subject to any disclaimer, the term of this patent is extended or adjusted under 35 U.S.C. 154(b) by 1142 days.

(21) Appl. No.: 11/443,747

(22) Filed: May 30, 2006

(65) Prior Publication Data

US 2007/0279433 A1 Dec. 6, 2007

(51) Int. Cl.
*G09G 5/10* (2006.01)

(52) U.S. Cl. ..... 345/690

(58) Field of Classification Search ..... 345/89, 345/601, 602, 690–692; 348/674
See application file for complete search history.

(56) References Cited

U.S. PATENT DOCUMENTS 6,215,468 B1 4/2001 Van Mourik ..... 34/605
6,727,959 B2 * 4/2004 Eskin ..... 348/674
6,833,876 B1 * 12/2004 Pirjaberi ..... 348/674
6,919,691 B2 * 7/2005 Mizukoshi et al. ..... 315/169.1
7,061,504 B1 * 6/2006 Glen ..... 345/600
2003/0122754 A1 7/2003 Bu ..... 345/887
2005/0140597 A1 * 6/2005 Lee et al. ..... 345/76
2006/0022927 A1 * 2/2006 Woo et al. ..... 345/89
2006/0158420 A1 * 7/2006 Chang et al. ..... 345/100
2007/0103416 A1 * 5/2007 Kim ..... 345/88
2007/0216812 A1 * 9/2007 Shimizu ..... 348/624
2007/0262932 A1 * 11/2007 Tang et al. ..... 345/77

* cited by examiner

*Primary Examiner*—Sumati Lefkowitz
*Assistant Examiner*—Rodney Amadiz
(74) *Attorney, Agent, or Firm*—J.C. Patents

(57) ABSTRACT

A gamma correction device and method for a display device are provided, which requires fewer look-up tables and small-size driving voltage generating circuits to generate three sets of driving voltages. A plurality of difference values between three gamma curves R, G, and B and a reference curve is stored in the look-up table. According to the look-up table, a selection signal SEL is obtained based on a gray scale signal. Moreover, a most significant bit (MSB) signal is extracted from the gray scale signal. Then, several analog voltages are generated from a voltage source through voltage division. After that, the selection signal and the MSB signal are decoded so as to select one from the analog voltages and convert to a driving voltage. The driving voltage is used to drive the display device.

26 Claims, 2 Drawing Sheets

GAMMA CORRECTION DEVICE OF DISPLAY APPARATUS AND METHOD THEREOF

BACKGROUND OF THE INVENTION

1. Field of Invention

The present invention relates to an apparatus and method for driving a display device, and more particularly to an apparatus and method for driving a display device via a single driving voltage generating circuit.

2. Description of Related Art

Since liquid crystal display (LCD) has many advantages such as light, thin, short, and small, with low energy consumption and low radiation, it has come to be widely used in recent years.

In the liquid crystal panel of an LCD display, the relationship between the voltage applied to the liquid crystal molecule (referred as driving voltage below) and the light transmittance of a pixel is a gamma curve, rather than a linear relationship. By correcting the gamma curve, the gray scale signal of the pixel and the light transmittance of the liquid crystal molecule can be made to have a near linear relation, thus, the displayed image for an LCD is more desirable.

In an LCD display, each display unit, i.e. a pixel, consists of three sub-pixels. Each sub-pixel is used to display one of the three primary colors of red (R), green (G), and blue (B). Depending on which primary color a sub-pixel displays, the corresponding gamma curve will be different. Referring to FIG. 1*a* which shows three gamma curves R, G, B, which respectively represent the relationship between the gray scale signals and the light transmittances when the sub-pixel displays red, green, and blue, respectively.

In order to obtain different driving voltages to display red, green and blue, in the conventional technology, three R/G/B look-up tables and three gamma voltage generating circuits are used respectively to obtain three sets of driving voltages corresponding to the R/G/B gray scale signals to drive the liquid crystal molecules. However, this prior art requires a relatively large memory space for storing three look-up tables, and three gamma voltage generating circuits will dramatically increase the area of the drive circuit.

Thus, it is preferred to have an apparatus and method for driving a liquid crystal display, which only needs a relatively small storage space for a look-up table and a gamma voltage generating circuit to generate the required three sets of driving voltages.

SUMMARY OF THE INVENTION

One of the objects of the present invention is to provide an apparatus and method for a display device, which uses fewer look-up tables and small-size gamma voltage generating circuits to generate three sets of driving voltages.

In order to achieve the above object, the present invention provides an apparatus and method for a display device. A plurality of difference values between the gamma curves R, G, and B and the reference curve is stored in a look-up table. The reference curve can be any combination of the gamma curves R, G, and B, a calculation result of the gamma curves R, G, and B, or a combination thereof.

According to the look-up table, an identification bit and a gray scale signal, a selection signal SEL can be obtained. The selection signal is the binary value of the difference value. The identification bit is used for identifying that the gray scale signal is a red (R) gray scale signal, a green (G) gray scale signal, or a blue (B) gray scale signal. A most significant bit (MSB) signal is extracted from the gray scale signal. The MSB signal is the most significant bit of the gray scale signal.

N analog voltages are generated from a voltage source through voltage division, where, $n=2^{(p+q)}$, and p and q are respectively the number of bits of the selection signal and the MSB signal.

The selection signal and the MSB signal are decoded, so as to select one from the analog voltages and convert it to a driving voltage that is used to drive the display device.

With the above techniques and features, fewer look-up tables, small-size gamma voltage generating circuit and a digital-to-analog conversion circuit are required in the present invention to generate the three sets of driving voltages required by sub-pixels to display red, green, or blue. Thus, the circuit area can be significantly saved.

In order to make aforementioned and other objects, features and advantages of the present invention more comprehensible, preferred embodiments accompanied with appended drawings are described in detail as below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1A:
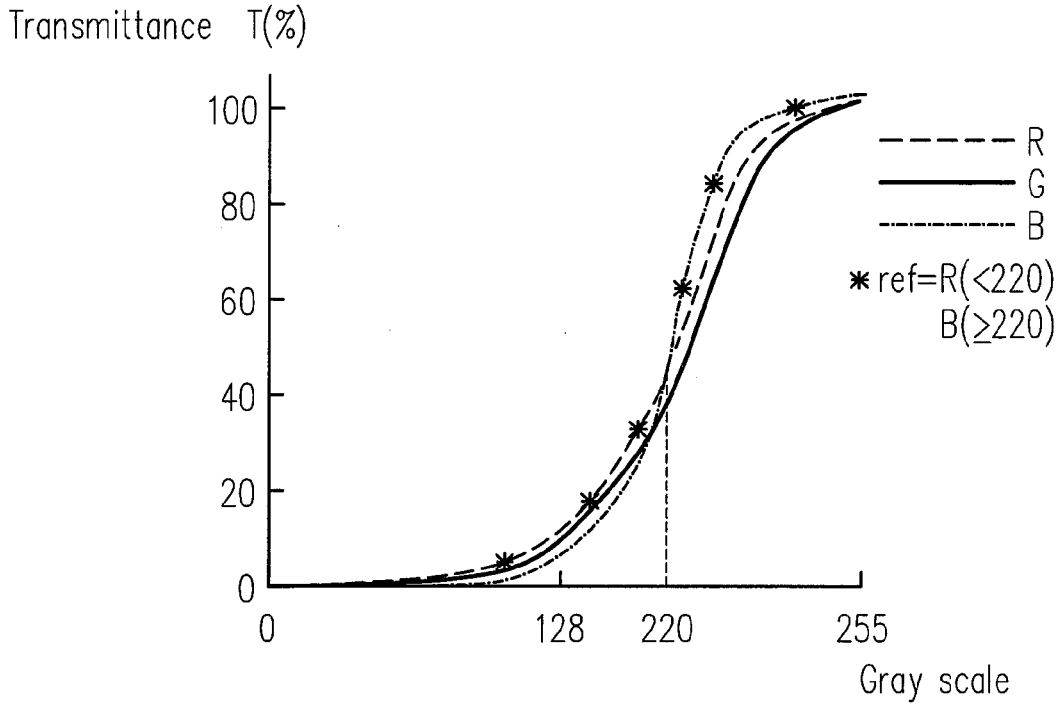
FIG. 1*a* shows a characteristic view of gamma curves R/G/B and the reference curve ref to the light transmittance.

In the present invention, a reference curve is found out according to three common or predetermined gamma curves R/G/B. The reference curve can be any combination of the three gamma curves, or a calculation result (such as average value) of the three gamma curves or a combination thereof. Then, the difference values between the reference curve and each gamma curve at every gray scale value are found out, and then are all stored in a look-up table. Thus, the signals required for gamma correction can be obtained according to the difference values between the reference curve and each corresponding gamma curve. Then, simpler source driving circuit is used to generate the driving voltages required by pixels to display red, green, or blue.

Again referring to FIG. 1*a*, a reference curve ref is further defined in the present embodiment, in addition to the three gamma curves R, G, and B. The reference curve ref is defined as, for example, the biggest one of the three gamma curves R, G, and B at each corresponding gray scale value. For instance, taking FIG. 1*a* as an example, when the gray scale value is less than 220, the gamma curve R is the biggest one; when the gray scale value is greater than or equal to 220, the gamma curve B is the biggest one. Therefore, the reference curve ref can be defined as follows: when the gray scale value is less than 220, the reference curve ref is equal to (i.e., overlaps with) the gamma curve R; when the gray scale value is greater than or equal to 220, the reference curve ref is equals to (i.e., overlaps with) the gamma curve B.

Then, difference values between the three gamma curves R, G, B and the reference curve ref at each gray scale value are found out. Taking FIG. 1*a* as an example, the difference values at each gray scale value are listed in Table 1 as below.

TABLE 1

| | gray scale value | | | | | | | | | | |
|---|---|---|---|---|---|---|---|---|---|---|---|
| | 0 | 1 | ... | 127 | 128 | ... | 220 | 221 | ... | 254 | 255 |
| R difference value | 0 | 0 | ... | 0 | 0 | ... | 0 | 1 | ... | 0 | 0 |
| G difference value | 0 | 0 | ... | 5 | 5 | ... | 6 | 6 | ... | 0 | 0 |
| B difference value | 0 | 0 | ... | 7 | 7 | ... | 0 | 0 | ... | 0 | 0 |

In the above Table 1, R difference value represents the difference values between the gamma curve R and the reference curve ref; G difference value represents the difference values between the gamma curve G and the reference curve ref; and B difference value represents the difference values between the gamma curve B and the reference curve ref. In Table 1, "0" represents that there is no difference between the gamma curve and the reference curve at that gray scale value. In this embodiment, the maximum of the difference value is 7, and the minimum is 0. For the sake of simplicity, only the R/G/B difference values corresponding to some gray scale values are listed in Table 1, and the R/G/B difference values corresponding to other gray scale values can be known with reference to FIG. 1*a*.

Referring to FIG. 1*a* together with Table 1, when the gray scale value is less than 220, the reference curve ref overlaps with the gamma curve R, such that the R difference value is 0; and meanwhile, the difference between the gamma curve B and the reference curve ref is greatest, such that the B difference value is larger than the R difference value and the G difference value; and the G difference value is a medium one between the B difference value and the R difference value. Similarly, when the gray scale value is more than or equal to 220, the reference curve ref overlaps with the gamma curve B, such that the B difference value is 0; the difference between the gamma curve G and the reference curve ref is greatest, such that the G difference value is larger than the R difference value and the B difference value; and the R difference value is a medium one between the B difference value and the G difference value.

Figure 1B:
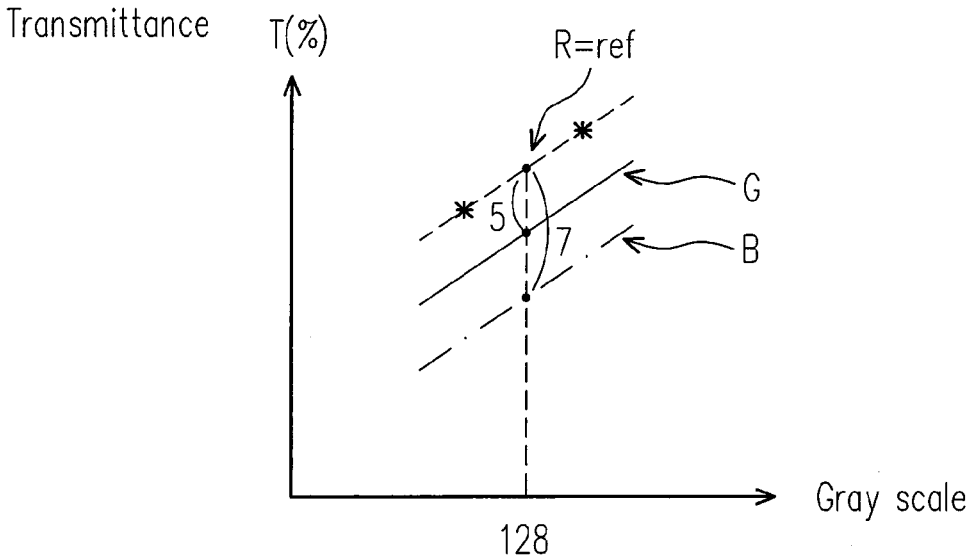
FIG. 1*b* shows an enlarged view of a part of FIG. 1*a*.

Referring to FIG. 1*b*, it is an enlarged view of a part of FIG. 1*a*. FIG. 1*b* shows the relationship between the three gamma curves R, G, B and the reference curve ref at a gray scale value of 128. It can be known from Table 1 that, at the gray scale value of 128, the R difference value is 0, the G difference value is 5, and the B difference value is 7.

To sum up, it can be known that, in the present embodiment, the three gamma curves R/G/B can be derived by looking up the table so long as each of the difference values are stored. In the present embodiment, there is no need to store the three gamma curves R/G/B respectively, thus saving much more memory space.

Figure 2:
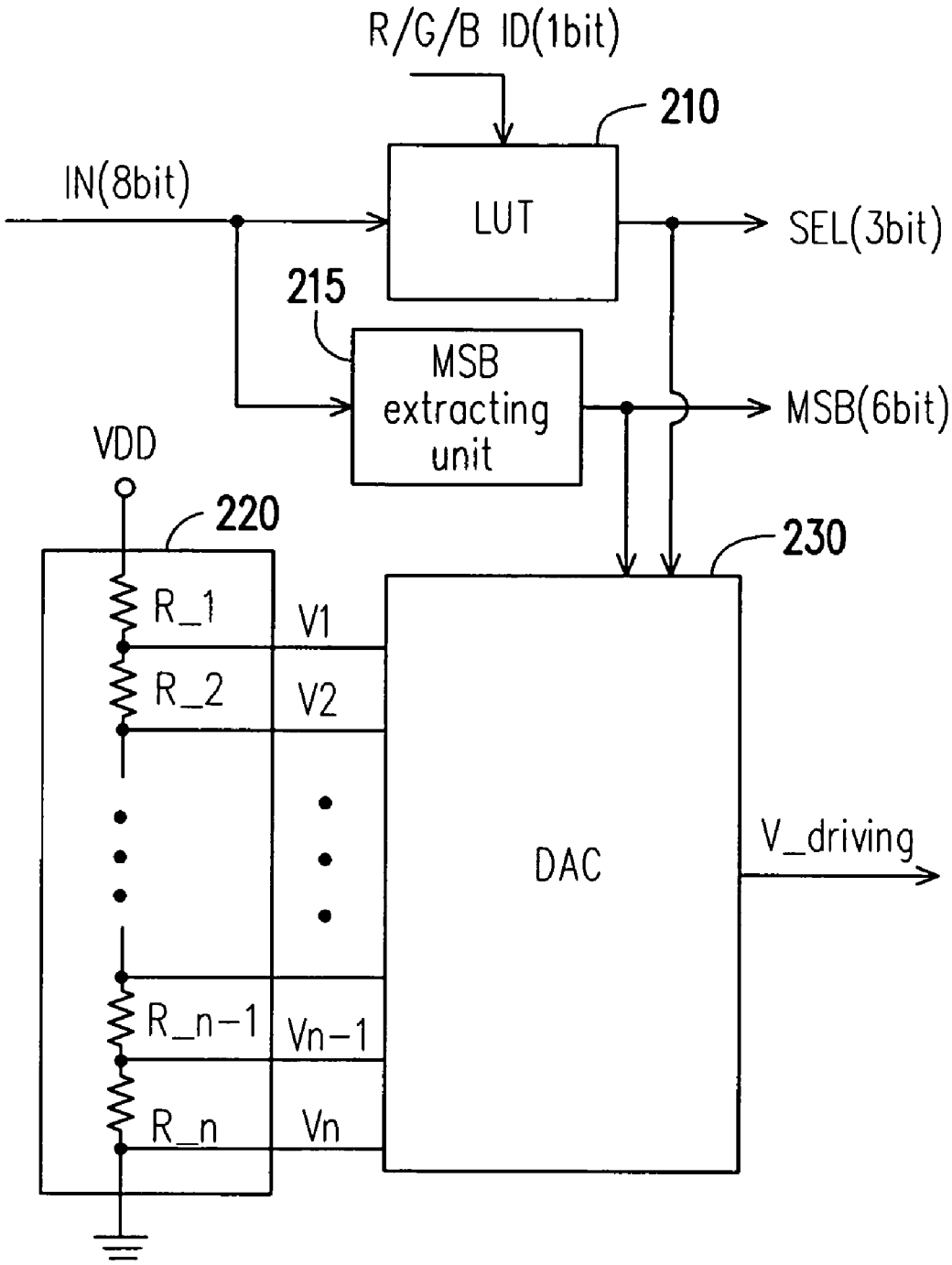
FIG. 2 shows a schematic view of a circuit according to an embodiment of the present embodiment.

FIG. 2 shows a schematic view of an apparatus for driving a display device according to the present embodiment. As shown in FIG. 2, the apparatus for driving a display device comprises a look-up table (LUT) 210, an MSB extracting unit 215, a gamma voltage generating circuit 220 and a digital-to-analog conversion unit (DAC) 230. The driving voltage generated by the DAC 230 drives the sub-pixels to display R/G/B.

Referring to FIG. 2, the 8-bit gray scale signal IN is input into the LUT 210. The LUT 210 is used for storing the difference values of the three gamma curves R/G/B relative to the reference curve, for example, as shown in FIGS. 1*a* and 1*b*. Moreover, the LUT 210 further receives a R/G/B identification signal ID (at least one 1-bit) for identifying the input gray scale signal as R, G or B.

Then, a 3-bit selection signal SEL can be obtained via the LUT 210. The selection signal SEL is the binary value of the difference value in Table 1. In this embodiment, a 6-bit MSB (most significant bit) is extracted from the 8-bit gray scale signal IN by the MSB extracting unit 215. The architecture of the MSB extracting unit 215 is not particularly restricted herein, as long as it can achieve the required functionality. The 6-bit MSB and the 3-bit selection signal SEL will be input into the DAC 230.

A plurality of analog voltages V1-Vn (in this embodiment, $n=2^9$) is generated from the voltage source VDD by the gamma voltage generating circuit 220. For example, the gamma voltage generating circuit 220 includes n serial-connected resistors R_1-R_n. The analog voltages V1-Vn can be obtained from a voltage division on the voltage source VDD by the resistors R_1-R_n and then they are input into the DAC 230. The gamma voltage generating circuit 220 must be conformed to the reference curve ref, so as to perform gamma correction.

The DAC 230 receives the 6-bit MSB and the 3-bit selection signal SEL, and then combines them together to obtain a 9-bit signal. Then, the DAC 230 decodes the 9-bit signal, and selects one analog voltage from the analog voltages V1-Vn, and outputs an analog driving voltage V_driving.

The driving voltage V_driving generated by DAC 230 is provided to drive the sub-pixels of the liquid crystal display (LCD) panel of the display device.

Therefore, in this embodiment, the gamma correction is performed on the gray scale signal IN via the combination of the gamma voltage generating circuit 220 (conformed to the reference curve ref) and the DAC 230 (especially, receiving the 3-bit selection signal SEL), such that a near linear relationship exists between the gray scale signal IN and the light transmittance of the pixel.

In this embodiment, it is supposed that the gray scale signal is 8-bit. However, those skilled in the art will know that the present invention also can be applied to the gray scale signals of other bits. Besides, reference curve ref can also be defined as the smallest one, or any combination of the three gamma curves R, G, and B at each corresponding gray scale value.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An apparatus for driving a display device, comprising:

a look-up table, storing a plurality of difference values between first, second and third gamma curves and a reference curve, whereby a selection signal is obtained based on a gray scale signal and the look-up table;

a bit extracting unit, generating a MSB signal by extracting at least one most significant bit from the gray scale signal; and a digital-to-analog conversion unit, generating a driving voltage for the display device according to the selection signal and the MSB signal.

2. The apparatus for driving a display device as claimed in claim 1, wherein the selection signal includes a binary value of the difference value.

3. The apparatus for driving a display device as claimed in claim 1, wherein when the gray scale signal is an 8-bit signal, the selection signal is a 3-bit signal and the MSB signal is a 6-bit signal.

4. The apparatus for driving a display device as claimed in claim 3, wherein the bit extracting unit generates the MSB signal by extracting 6 most significant bits from the gray scale signal.

5. The apparatus for driving a display device as claimed in claim 1, wherein the number of the analog voltages is relevant to the sum of bits of the selection signal and the MSB signal.

6. The apparatus for driving a display device as claimed in claim 1, wherein the look-up table further receives an identification bit used for identifying that the gray scale signal is a red (R) gray scale signal, a green (G) gray scale signal, or a blue (B) gray scale signal.

7. The apparatus for driving a display device as claimed in claim 1, wherein the reference curve is relevant to the first to the third gamma curves.

8. The apparatus for driving a display device as claimed in claim 1, further comprising a driving voltage generating circuit, coupled to a voltage source for generating a plurality of analog voltages.

9. The apparatus for driving a display device as claimed in claim 8, wherein the driving voltage generating circuit includes a plurality of serial-connected resistors for dividing a voltage from the voltage source to generate the analog voltages.

10. The apparatus for driving a display device as claimed in claim 1, wherein the reference curve is a combination or a calculation result of the first, second and third gamma curves, or a combination thereof.

11. A method for driving a display device, comprising the steps of:

providing first, second and third gamma curves and a reference curve;

obtaining a selection signal based on the gray scale signal and a plurality of difference values between the first, second and third gamma curves, and the reference curve;

obtaining a MSB signal by extracting a least one most significant bit from the gray scale signal; and generating a driving voltage for the display device according to the MSB and selection signal.

12. The method as claimed in claim 11, wherein the selection signal represents a binary value of the difference value.

13. The method as claimed in claim 11, wherein when the gray scale signal is an 8-bit signal, the selection signal is a 3-bit signal and the MSB signal is a 6-bit signal.

14. The method as claimed in claim 11, wherein the number of the analog voltages is relevant to the sum of bits of the selection signal and the MSB signal.

15. The method as claimed in claim 11, wherein the reference curve is relevant to the first, second and third gamma curves.

16. The method as claimed in claim 11, wherein the reference curve is any combination or a calculation result of the first, second and third gamma curves, or a combination thereof.

17. The method as claimed in claim 11, further comprising:

identifying that the gray scale signal is a red gray scale signal, a green gray scale signal, or a blue gray scale signal according to an identification bit.

18. The method as claimed in claim 11, wherein the step of generating a driving voltage comprises:

generating a plurality of analog voltages; and selecting one of the analog voltages as a driving voltage for the display device according to the selection signal and the MSB signal.

19. The method as claimed in claim 18, wherein the step of generating the analog voltages comprises:

dividing a voltage from the voltage source by a plurality of serial-connected resistors to generate the analog voltages.

20. A method for driving a display device, comprising the steps of:

receiving a gray scale signal and a color information which is used to identify the gray scale signal as a red gray scale signal, a green gray scale signal, or a blue gray scale signal;

obtaining a MSB signal by extracting at least one most significant bit from the gray scale signal;

obtaining a selection signal based on the gray scale signal and the color information, wherein the gray scale signal is an 8-bit digital signal, the MSB signal is a 6-bit digital signal and the selection signal is a 3-bit digital signal; and generating a driving voltage for the display device according to the MSB signals, and the selection signal, wherein the step of generating a driving voltage comprises:

generating a plurality of analog voltages; and selecting one of the analog voltages as the driving voltage according to the MSB signal and the selection signal.

21. The method as claimed in claim 20, wherein the step of obtaining the selection signal comprises:

providing a look-up table; and looking up the selection signal from the look-up table according to the gray scale signal and the color information.

22. The method as claimed in claim 20, wherein the step of generating the driving voltage further comprises combining the MSB signal and the selection signal.

23. An apparatus for driving a display device, comprising:

a look-up table, receiving a gray scale signal and a color information which is used to identify the gray scale signal as a red gray scale signal, a green gray scale signal, or a blue gray scale signal, and outputting a selection signal according to the gray scale signal and the color information, wherein the look-up table stores a plurality of difference values between plural color gamma curves and a reference curve;

a bit extracting unit, generating a MSB signal by extracting at least one most significant bit from the gray scale signal; and a digital-to-analog conversion unit, generating a driving voltage for the display device according to the MSB signal and the selection signal.

24. The apparatus as claimed in claim 23, wherein the selection signal is selected from one of the difference values.

25. The apparatus as claimed in claim 24, while the color information designates a first color, the selection signal is a difference value between the first color gamma curve and the reference curve with respect to the gray scale signal.

26. The apparatus as claimed in claim 23, wherein the color gamma curves comprises red, green and blue gamma curves.

* * * * *